US011583753B2

(12) United States Patent
Stanek

(10) Patent No.: US 11,583,753 B2
(45) Date of Patent: Feb. 21, 2023

(54) FIXATION OF BINDING BOARD TO SPLITBOARD SKIS

(71) Applicant: Michal Stanek, Mesto (CZ)

(72) Inventor: Michal Stanek, Mesto (CZ)

( * ) Notice: Subject to any disclaimer, the term of this patent is extended or adjusted under 35 U.S.C. 154(b) by 0 days.

(21) Appl. No.: 17/420,059

(22) PCT Filed: Mar. 10, 2020

(86) PCT No.: PCT/CZ2020/000010
§ 371 (c)(1),
(2) Date: Jun. 30, 2021

(87) PCT Pub. No.: WO2020/182236
PCT Pub. Date: Sep. 17, 2020

(65) Prior Publication Data

US 2022/0047934 A1 Feb. 17, 2022

(30) Foreign Application Priority Data

Mar. 11, 2019 (CZ) ..... PUV 2019-35999

(51) Int. Cl.
*A63C 5/03* (2006.01)
*A63C 9/08* (2012.01)
*A63C 10/14* (2012.01)

(52) U.S. Cl.
CPC ..... *A63C 5/031* (2013.01); *A63C 9/08* (2013.01); *A63C 10/14* (2013.01); *A63C 2203/06* (2013.01)

(58) Field of Classification Search
CPC ..... A63C 5/031; A63C 9/08; A63C 10/14; A63C 2203/06; A63C 9/0807;
(Continued)

(56) References Cited

U.S. PATENT DOCUMENTS 5,561,886 A * 10/1996 Flamme ..... H02B 1/38 16/265
7,823,905 B2 * 11/2010 Ritter ..... A63C 10/14 280/14.26
9,884,243 B2 * 2/2018 Wariakois ..... A63C 10/14
10,035,058 B1 * 7/2018 Ritter ..... A63C 9/0807
11,426,647 B2 * 8/2022 Wariakois ..... A63C 10/18
(Continued)

FOREIGN PATENT DOCUMENTS

CH 711713 A2 * 5/2017
CZ 32788 U1 * 4/2019
(Continued)

OTHER PUBLICATIONS

Video: Enfuse Brand—El Stylo Splitboard Binding; https://www.youtube.com/watch?v=VdaDXnsRg7w; Jan. 27, 2020.

*Primary Examiner* — James A Shriver, II
*Assistant Examiner* — Michael T. Walsh
(74) *Attorney, Agent, or Firm* — Bryant J. Keller; Kirton McConkie

(57) ABSTRACT

Systems and methods for fixing a binding board to skis that are removably connected together to form of a splitboard are described herein. In some cases, the described systems use a sliding and removable setting of bearing pins in eyes that are formed on adjacent areas of the board and a clamp that is fixed to the skis. The essence of the invention is a fixation of lateral parts of the eyes by stoppers which partially overreach into cross sections of the eyes. A diameter of the bearing pins basically corresponds with a diameter of the eyes. The bearing pins are equipped with circular recesses for engaging with the stoppers and also with end parts that each have a truncated conical tip.

4 Claims, 4 Drawing Sheets

Figure 1:
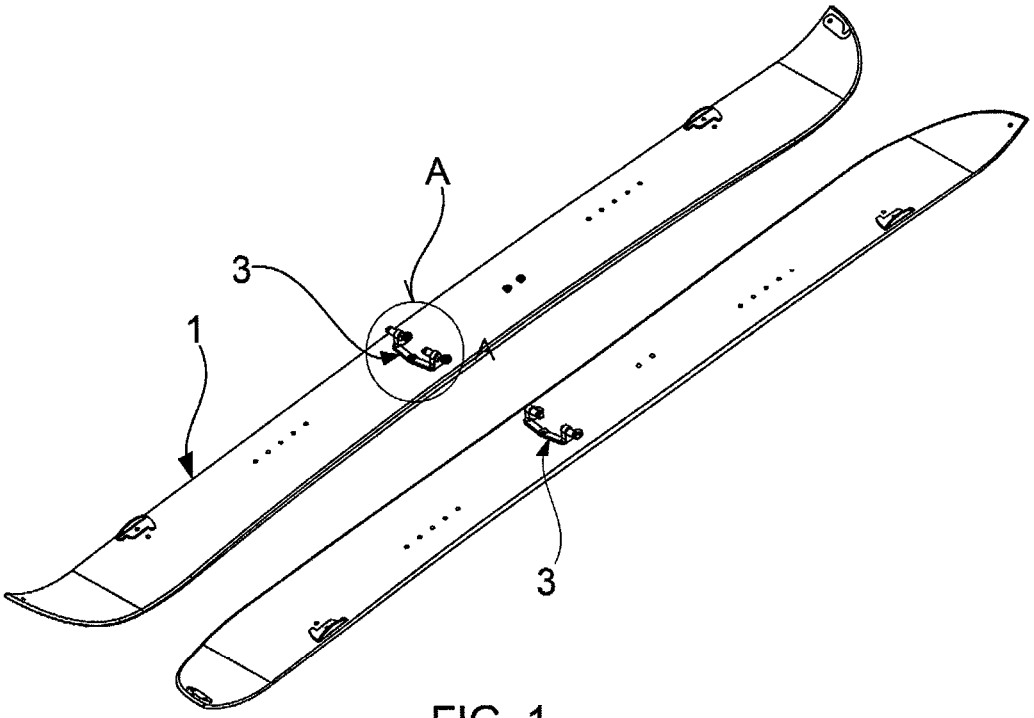

(58) Field of Classification Search
CPC ..... A63C 10/28; A63C 10/04; A63C 2203/10; E05D 3/06; E05D 3/12; E05D 5/10; E05D 5/128; E05D 7/12; E05D 7/121; E05D 7/125
See application file for complete search history.

(56) References Cited

U.S. PATENT DOCUMENTS

| | | | | |
|---|---|---|---|---|
| 2010/0219614 | A1* | 9/2010 | Ekberg | A63C 13/006 280/623 |
| 2012/0256395 | A1* | 10/2012 | Ritter | A63C 10/28 280/623 |
| 2012/0274036 | A1* | 11/2012 | Kloster | A63C 9/006 280/11.31 |
| 2013/0341889 | A1* | 12/2013 | Neubauer | A63C 9/02 280/607 |
| 2014/0210187 | A1* | 7/2014 | Ritter | A63C 9/02 280/611 |
| 2015/0014962 | A1* | 1/2015 | Rayner | A63C 10/18 280/611 |
| 2015/0343298 | A1* | 12/2015 | Ritter | A63C 10/14 280/11.31 |
| 2016/0199722 | A1* | 7/2016 | Ritter | A63C 9/02 280/617 |
| 2018/0353839 | A1* | 12/2018 | Shute | A63C 9/0805 |

FOREIGN PATENT DOCUMENTS

| | | | | |
|---|---|---|---|---|
| CZ | 32788 | U1 | 4/2019 | |
| DE | 19915718 | A1 * | 10/2000 | E05D 5/128 |

* cited by examiner

FIXATION OF BINDING BOARD TO SPLITBOARD SKIS

FIELD

The invention relates to equipment used for the pursuit of winter sports. More specifically, the invention relates to construction of a new design for fixing a board of binding (or a baseboard of a binding) to a ski of a splitboard by moving the board into a so called "ascending mode".

BACKGROUND

In recent years, there has been a massive spread, not only of snowboarding, but also of splitboarding, which is based on use of a snowboard that is divided lengthwise into two boards such that it is possible to use them connected for a downhill ride and such that when they are divided, they can be used in an uphill ascent, as classic hiking skis (of cross country skis) in similar way as skialp. For performance of these alternative functions, it was necessary to modify the binding for easy modification for various modes of ride and to complete it with other functional elements which would enable easy connection and disconnection of snowboard board into two separate boards and also would provide a safe fixation of base portion of the binding for both modes of use.

Many systems have been invented and operated to allow for construction and locking of a base portion of binding and whose designs were described, for example, in U.S. Pat. Nos. 7,823,905, 10,035,058, US20140210187 US2012274036, US2015014962, WO2018138052, US2013341889 or U.S. Pat. No. 9,884,243. Some of these solutions have structurally complicated fixation systems that use many movable parts whose functionality gets worse when such parts are frozen or dogged with snow. Other systems with a simple structure are more demanding for manipulation and their functionality also gets worse when they are frozen or dogged with snow. Many systems then solve fixation of a back block and its setting for different angles for use in ascending mode as it is noticeable, for example, from US2012274036, US2015343298, US2016199722 or U.S. Pat. No. 7,823,905. Some files also regard design of a front clamp for fixation of a base portion in ascending mode, as is described in U.S. Pat. Nos. 7,823, 905, 10,035,058, US2012274036, US2013341889 or US2013341889. There are described also designs where there is coupling of the base portion and the clamp that is done by the help of a side insertion of pins which are formed on a front face of the base portion on horizontally, situated eyes which are formed on the clamp in a direction which is perpendicular to a lengthwise axis of a ski. Disadvantage of these known designs is known in that for provision of axial fixation of the pins in the eyes these structural nodes are completed with other movable functional parts designed in the form of swiveling or turn over levers, stoppers or arms which means an increase of costs for production of these components. Moreover, each additional movable part is a source of a possible functionality failure and is prone to damage during repeated resetting. In the above-mentioned applications and patents there is also described a design where the base portion and the clamp are equipped with eyes and for their mutual coupling is used an independent pin. A disadvantage of this design is a very complicated manipulation during mutual coupling of particular structural nodes.

The aim of presented design is to introduce a new structural modification for fixation of the board of binding (or a baseboard of a binding) to a ski of a splitboard which is simple to produce and does not contain any movable functional elements and thus is functionally reliable with guarantee of a high comfort of service for the user during resetting of the splitboard into various modes.

ESSENCE OF THE INVENTION

A defined goal is achieved with an invention which regards fixation of a board of a binding to a ski of a splitboard, which is formed by two skis which are selectively connectable to form a snowboard board (or simply a snowboard) by the help of a sliding setting of bearing pins in eyes, which are created coaxially on adjacent surfaces of connected elements, wherein, lateral parts of the eyes are reinforced with stoppers which are formed and positioned so that they partially overreach (or extend) into a cross section of the eyes, wherein a diameter of bearing pins basically corresponds with a diameter of the eyes, wherein the bearing pins are equipped with circular recesses whose span corresponds with a span of a formation of the stoppers, and wherein an end of the hearing pins is equipped with a truncated conical tip.

In an advantageous design, the eyes are formed on the front face of the board, whereas they are with regard to a lengthwise axis of the board laterally offset and the bearing pins are fixed on the clamp.

Also is advantageous, when the circular recess of the conical tip is beveled and an upper edge of the bevel is in a plane which is tangent to a cylindrical area of the circular recess.

This new design according to the invention can achieve higher efficiency as it enables easy setting and fixation of the board of the binding on a front clamp only through placing and turning, without use of any movable part, and without its function being affected by clinging snow.

DESCRIPTION OF ENCLOSED DRAWINGS

Figure 2:
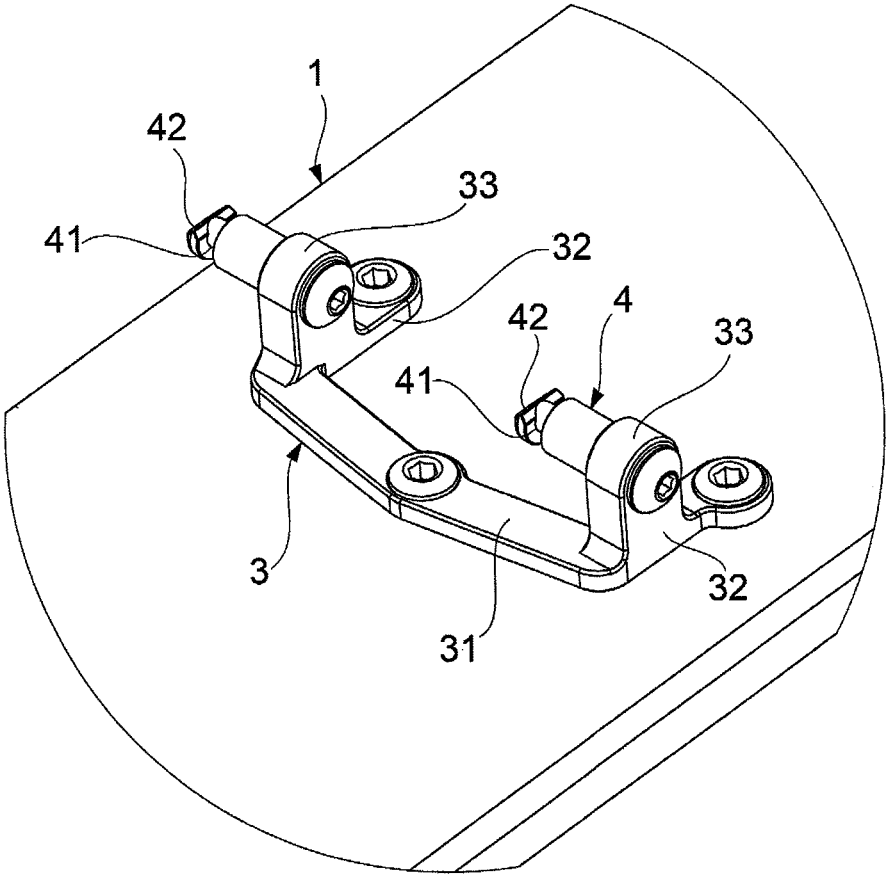
Figure 3:
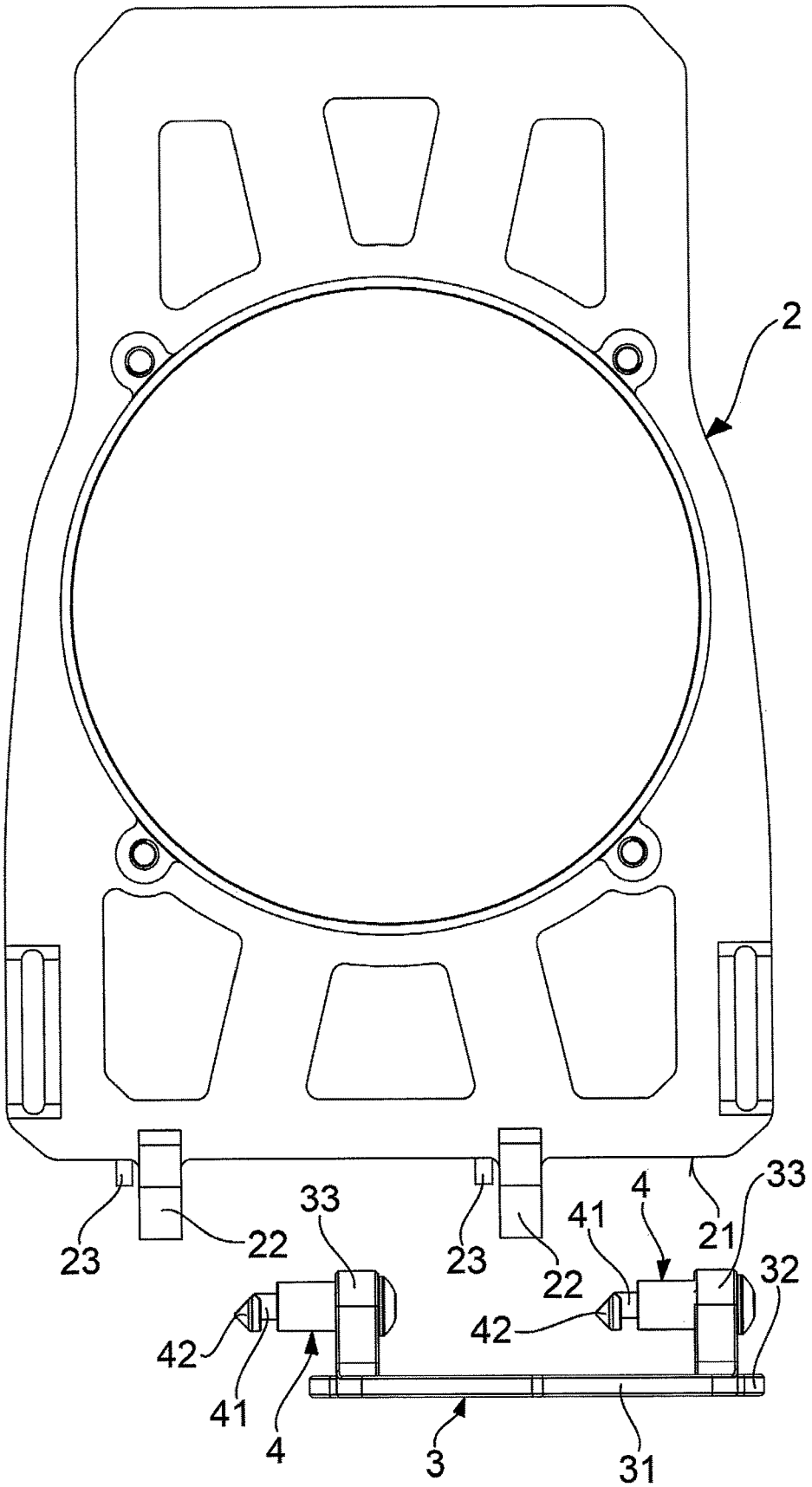

Particular examples of design of the invention are schematically illustrated in enclosed drawings where:

FIG. 1 is a view from above depicting skis of a splitboard, wherein the skis are equipped with front clamps, FIG. 2 is detailed A from FIG. 1, which illustrates an axonometric view on a front clamp, FIG. 3 if a frontal view of a board of a binding that is released from a holder and ready for fixation to the front clamp.

Figure 4A:
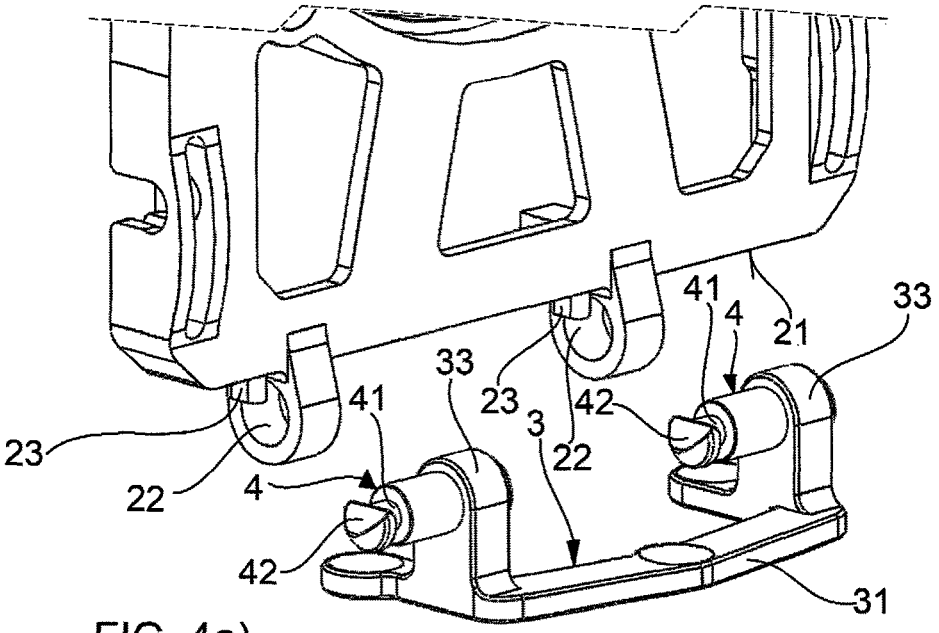
Figure 4B:
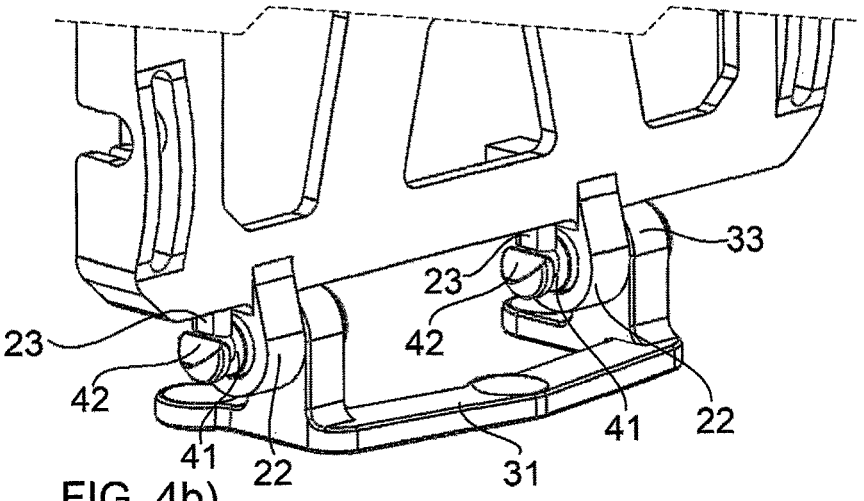
Figure 4C:
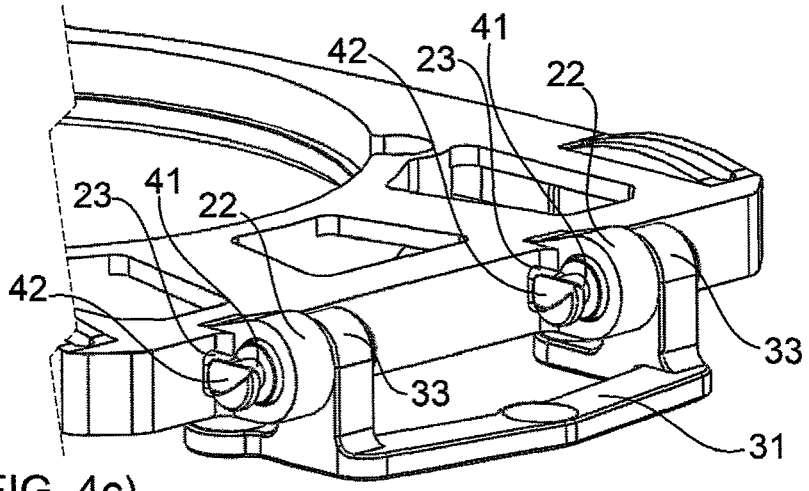
Figure 5:
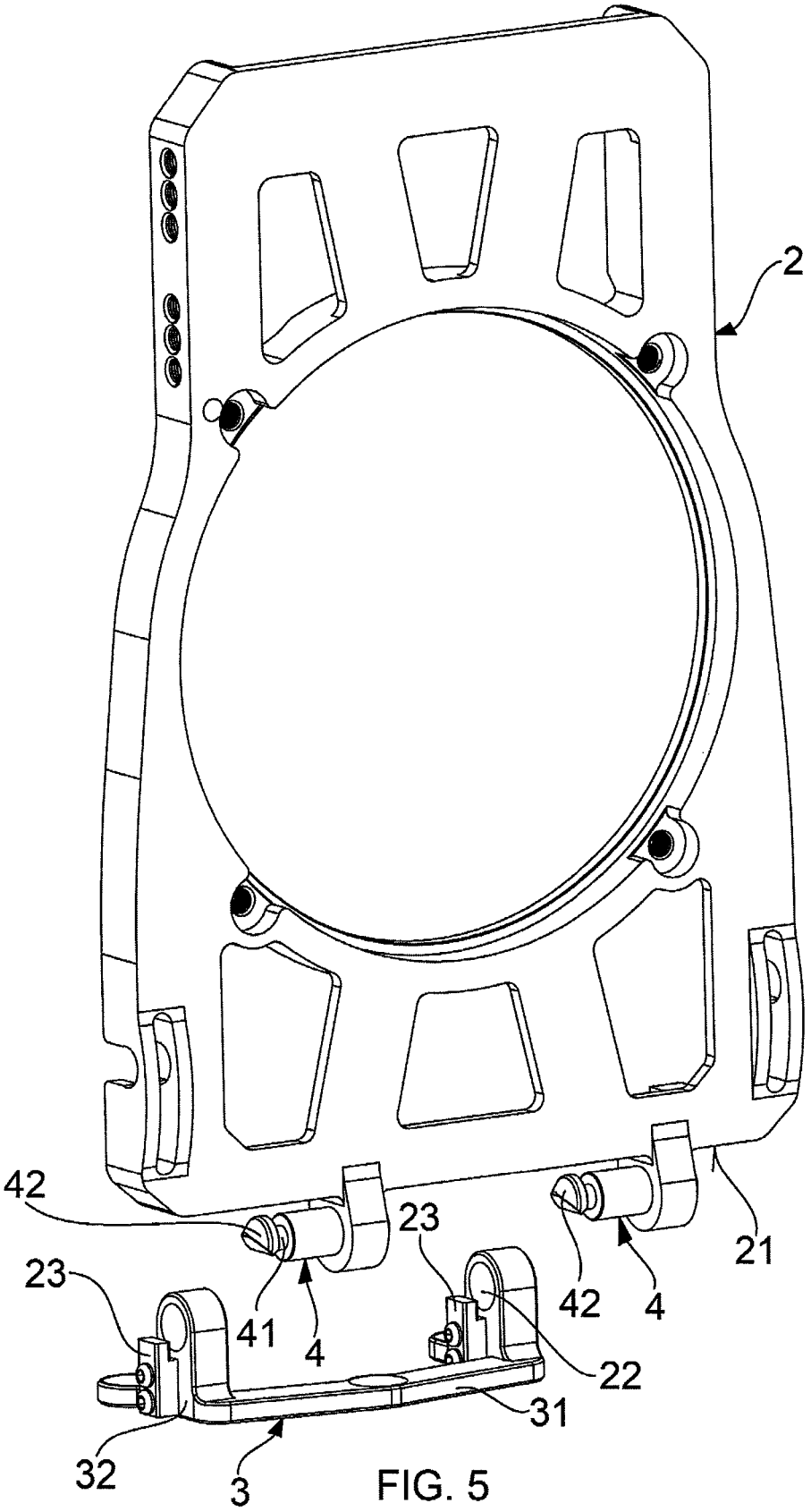

FIG. 4*a*) is as detailed view of a front face of the base portion before its fixation on the front clamp, FIG. 4*b*) is a detailed view of the front face of the base portion after it has been slid onto the front clamp, FIG. 4*c*) is a detailed view on the base portion which is fixated on a ski of a splitboard in ascending mode, and FIG. 5 is a view on an alternative design for fixation wherein eyes in the design are formed on the clamp and bearing pins are fixed on the board.

The drawings which illustrate embodiments of the introduced invention and described examples of particular designs do not, in any case, anyhow limit the extent of the protection set forth herein; yet merely clarify the essence of the invention.

EXAMPLES OF DESIGN OF THE INVENTION

The invention is designed for use for a splitboard which is formed by two skis 1 (as illustrated in FIG. 1), which are, by the help of two couplers of unmarked central connectors and two vertex connectors on a tip and a foot of standard design ski 1 such that the two skis are selectively couple together into a shape of a snowboard board. The subject of protection is fixation of a hoard 2 of a binding to a ski 1 by the help of its fixation with a front clamp 3 which is illustrated in FIG. 2.

On a front face 21 of the hoard 2 are formed two eyes 22, which are with regard to a lengthwise axis of the hoard 2 laterally, offset, whereas next to these eyes 22 are in the front face 21 fixed stoppers 23, which are formed and positioned in the way that they partially overreach into cross section of the eyes 22. The front clamp 3 is formed by a flat fork console, which has a broken connecting cross member 31 on its vertex and also in end parts of side arms 32 equipped with unmarked openings which enable selectively removable fixation of the clamp 3 to the ski 1 by the help of screw connections. On the side arms 32 are coaxially formed cases 33 in the way that their spacing is equal with spacing of the eyes 22 which are formed on the front face 21 of the board 2. In the cases 33 is fixed a couple of co-directionally oriented bearing pins 4, whose diameter basically corresponds with the diameters of the eyes 22 of the front face 21 and Which are equipped with circular recesses 41, whose cross section corresponds with the cross section of fixation of the stoppers 23 on the front face 21 of the board 2 and also are equipped with an end part with a one-sidedly from above truncated conical tip 42 (or a conical tip that is truncated on one side) formed in the way that the upper edge of its reduction is in a plane that is tangential to a cylindrical area of the circular recess 41.

During assembly of the splitboard, its stationary functional elements, namely the front clamps 3, are fixed, into predetermined positions on both skis. During reconfiguration of the splitboard into ascending mode are at first unlocked locks of central connectors and vertex connectors and the skis 1 are placed into a position (as illustrated in FIG. 1). Then each board 2 is placed into a vertical position (which is illustrated in FIG. 4*a*) and laterally with its eyes 22 is placed into the cases 33 of the clamp 3 (as is clear from the FIG. 4*b*). In the next step, the board 2 is turned 90°, (as is illustrated in FIG. 4*c*), and herewith comes to locking the stopper 23 into the circular recess 41 of the bearing pin 4 of the clamp 3 and coupling the board 2 with the ski 1. By this step is installation terminated. For release of the board 2 from the clamp 3 is the process performed in reverse order.

The described design is not the only possible solution according to the invention. Indeed, without changing the essence of the invention, it is possible to design the connecting cross member 31 of the clamp 3 and its side arms 32 according to the size and design of the board 2. Also, it is not important if the eyes 22 are formed on the board 2 and the bearing pins 4 on the clamp 3 or if are these elements formed in an opposite way, thus the bearing pins 4 on the front face 21 of the board 2 and the eyes 22 on the clamp 3, as it is illustrated in FIG. 5.

INDUSTRIAL UTILITY

The design of fixation of the board of the binding to a ski is designed for use for the splitboard whose design is aimed at provision of maximal comfort of the users with guarantee of simple manipulation during reconfiguration and minimization of failures of functional components.

LIST OF REFERENCE NUMERALS

1 Ski
2 Board
21 Front face
22 Eye
23 Stopper
3 Front clamp
31 Connecting cross member
32 Side arm
33 Case
4 Bearing pin
41 Circular recess
42 Tip

The invention claimed is:

1. A coupling system for fixing a board of a binding to a ski of a splitboard that is formed by two skis that are connectable to a form a snowboard, wherein the coupling system comprises at least two bearing pins and at least two eyes, wherein the at least two bearing pins are configured to selectively and respectively slide into the at least two eyes, wherein the at least two eyes are formed coaxially with each other, wherein a stopper is disposed adjacent to each of the at least two eyes, wherein each stopper extends past and into an inner diameter of the first of the at least two eyes, wherein an outer diameter of each of the at least two bearing pins substantially corresponds with inner diameters of the at least two eyes, wherein a tip of each of the at least two bearing pins defines a circular recess having a spacing that corresponds with a location of each stopper, and wherein each of the at least two bearing pins is equipped with an end part having a truncated conical tip.

2. The coupling system according to claim 1, wherein, the at least two eyes are formed on a front portion of the board of the binding, wherein the at least two eyes are offset laterally from each other on the board of the binding, and wherein the at least two bearing pins are fixed on a clamp that is configured to couple to the ski of the splitboard.

3. The coupling system according to claim 1, wherein, the truncated conical tip is beveled and a first edge of a beveled portion of the truncated conical tip comprises a planar surface that is tangential to a cylindrical area of the circular recess.

4. The coupling system according to claim 2, wherein, the truncated conical tip is beveled and a first edge of a beveled portion of the truncated conical tip comprises a planar surface that is tangential to a cylindrical area of the circular recess.

* * * * *